US009737178B1

(12) United States Patent
Crawford

(10) Patent No.: US 9,737,178 B1
(45) Date of Patent: Aug. 22, 2017

(54) TOWEL ASSEMBLY

(71) Applicant: Lorraine Crawford, Saint Peters, MO (US)

(72) Inventor: Lorraine Crawford, Saint Peters, MO (US)

( * ) Notice: Subject to any disclaimer, the term of this patent is extended or adjusted under 35 U.S.C. 154(b) by 0 days.

(21) Appl. No.: 15/218,152

(22) Filed: Jul. 25, 2016

(51) Int. Cl.
*A47K 10/02* (2006.01)
*A47K 7/02* (2006.01)

(52) U.S. Cl.
CPC ..... *A47K 7/022* (2013.01)

(58) Field of Classification Search
CPC ..... A47K 7/022; A47K 7/02; A47K 10/02
See application file for complete search history.

(56) References Cited

U.S. PATENT DOCUMENTS

| | | | |
|---|---|---|---|
| 2,035,014 | A | 3/1936 | Schaefer |
| 4,187,575 | A | 2/1980 | Collins |
| 4,761,849 | A | 8/1988 | Taylor |
| D381,545 | S | 7/1997 | Muttick et al. |
| 6,227,742 | B1 | 5/2001 | Corn et al. |

FOREIGN PATENT DOCUMENTS

| | | | |
|---|---|---|---|
| JP | 2004321718 | A * | 11/2004 |
| WO | WO2010141639 | | 12/2010 |

* cited by examiner

*Primary Examiner* — Shay Karls

(57) ABSTRACT

A towel assembly for washing a user's back includes a towel that may be manipulated during bathing. Thus, the towel may clean a user when the user bathes. The towel has a resiliently stretchable portion. The towel may be stretched along the user's back. Thus, the user may clean the user's back.

5 Claims, 3 Drawing Sheets

TOWEL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to towel devices and more particularly pertains to a new towel device for washing a user's back.

BRIEF SUMMARY OF THE INVENTION

An embodiment of the disclosure meets the needs presented above by generally comprising a towel that may be manipulated during bathing. Thus, the towel may clean a user when the user bathes. The towel has a resiliently stretchable portion. The towel may be stretched along the user's back. Thus, the user may clean the user's back.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
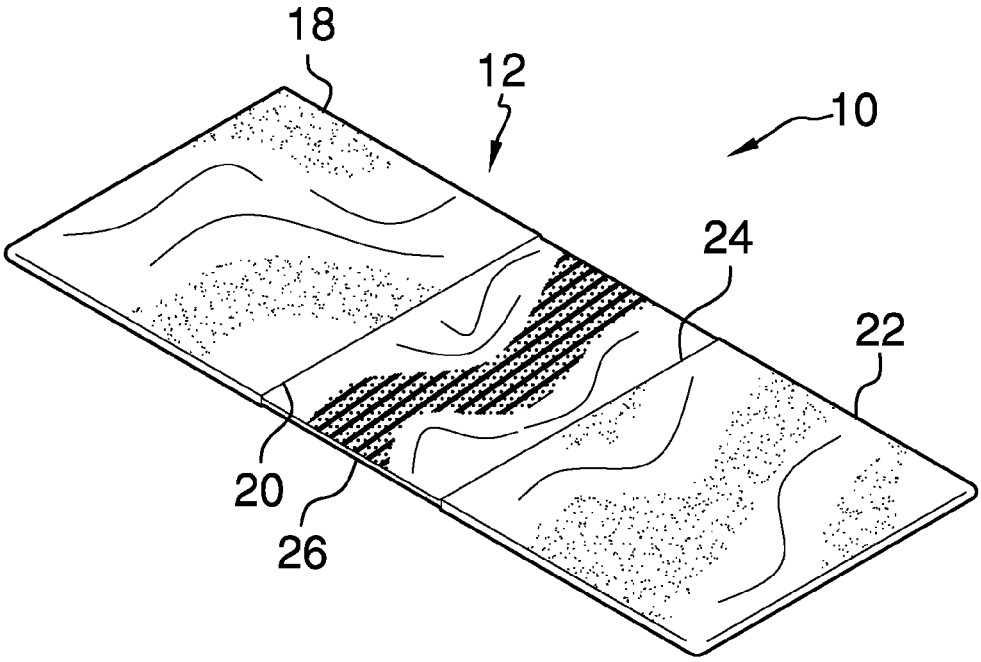
FIG. 1 is a top perspective view of a towel assembly according to an embodiment of the disclosure.
Figure 2:
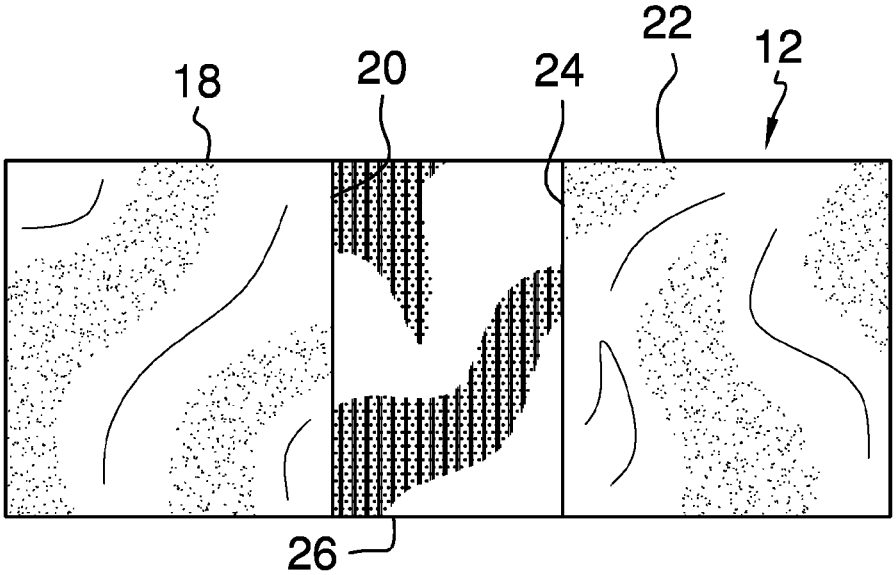
FIG. 2 is a bottom view of an embodiment of the disclosure.
Figure 3:
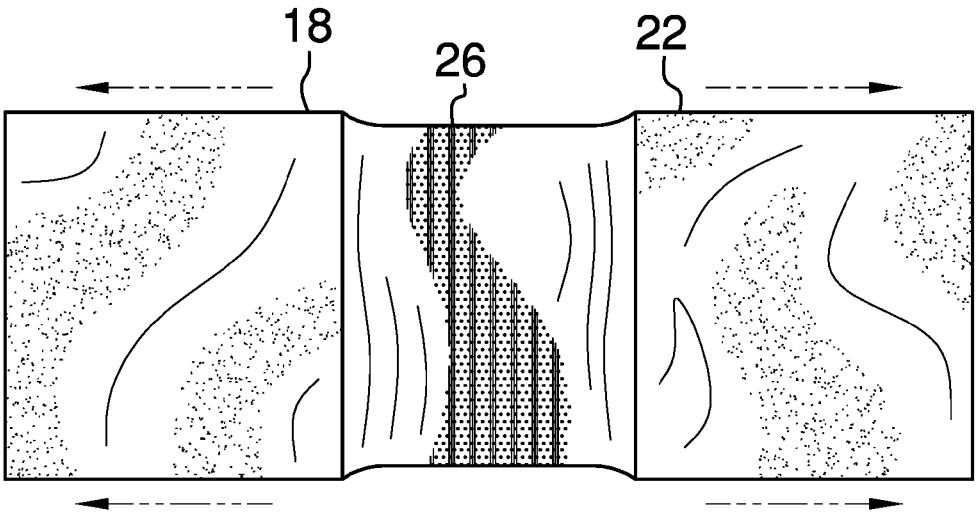
FIG. 3 is a top view of an embodiment of the disclosure.
Figure 4:
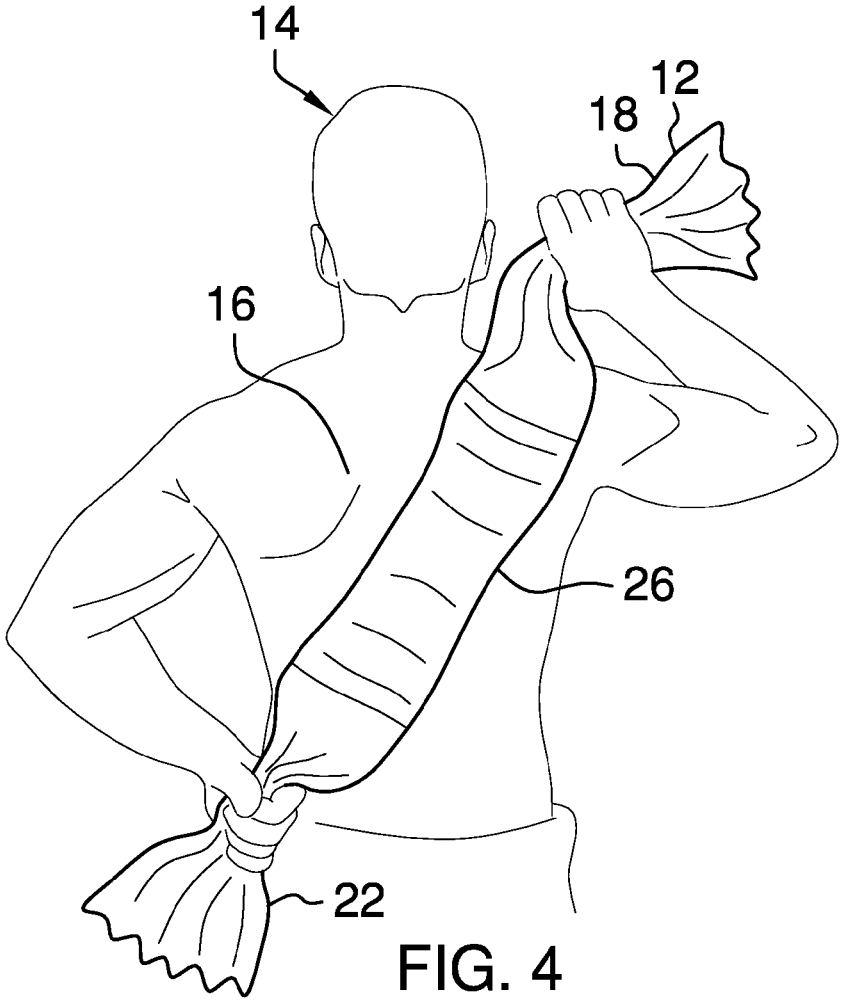
FIG. 4 is a back perspective in-use view of an embodiment of the disclosure.
Figure 5:
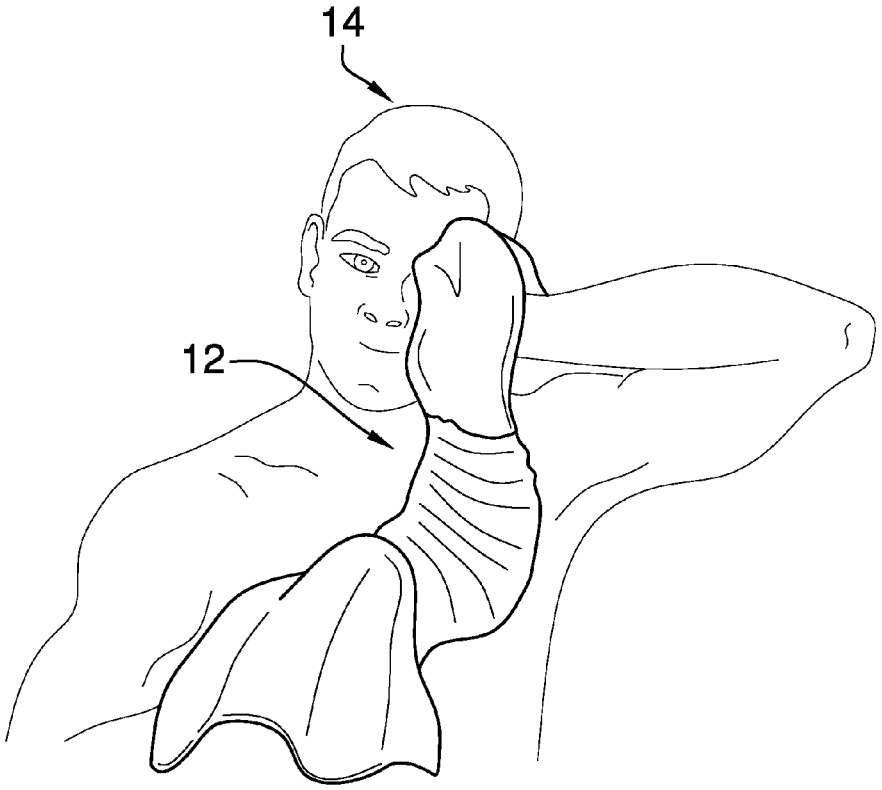
FIG. 5 is a front perspective in-use view of an embodiment of the disclosure.

With reference now to the drawings, and in particular to FIGS. 1 through 5 thereof, a new towel device embodying the principles and concepts of an embodiment of the disclosure and generally designated by the reference numeral 10 will be described.

As best illustrated in FIGS. 1 through 5, the towel assembly 10 generally comprises a towel 12 that may be manipulated during bathing. Thus, the towel 12 may clean a user 14 when the user 14 bathes. The towel 12 has a resiliently stretchable portion. The towel 12 may be stretched along the user's back 16 thereby facilitating the user 14 to clean the user's back 16.

The towel 12 comprises a first panel 18 that has a first edge 20. The first panel 18 is comprised of a fluid absorbent material such as terry cloth or the like. The first panel 18 may be manipulated when the user 14 bathes. Thus, the first panel 18 may wash the user 14 when the user 14 bathes.

A second panel 22 is provided and the second panel 22 has a second edge 24. The second panel 22 is comprised of a fluid absorbent material such as terry cloth or the like. The second panel 22 may be manipulated when the user 14 bathes. Thus, the second panel 22 may wash the user 14 when the user 14 bathes.

A third panel 26 is provided and the third panel 26 is coupled between the first edge 20 of the first panel 18 and the second edge 24 of the second panel 22. The third panel 26 is comprised of the resiliently stretchable material. Each of the first panel 18 and the second panel 22 are selectively urgeable away from each other. Thus, the user 14 may stretch the towel along the user's back 16.

The third panel 26 is comprised of a textured material. Thus, the third panel 26 may frictionally engage the user's back 16 when the towel 12 is stretched along the user's back 16. The third panel 26 scrubs the user's back 16 when the user 14 bathes. Thus, the user 14 may wash the user's back 16 without assistance.

In use, the towel 12 is manipulated when the user 14 bathes. The first panel 18 is manipulated to wash the user's head and user's upper torso. The second panel 22 is manipulated to wash the user's legs and lower torso. Thus, the user has a clean towel to wash the user's upper body and the user's lower body.

The towel 12 is positioned to extend along the user's back 16. Each of the first panel 18 and the second panel 22 are urged away from each other thereby facilitating the user 14 to stretch the towel 12 along the user's back 16. Thus, the towel 12 facilitates each of the user's arms to be positioned in a comfortable position when the towel 12 is stretched along the user's back 16. The third panel 26 frictionally engages the user's back 16 when the towel 12 is stretched along the user's back 16. Thus, the user 14 washes the user's back 16 without assistance.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A towel assembly having a resiliently stretchable portion wherein said towel is configured to scrub a user's back, said assembly comprising:

a towel being configured to be manipulated during bathing thereby facilitating said towel to clean a user, said towel having a resiliently stretchable portion wherein said towel is configured to facilitate the user to stretch said towel along the user's back thereby facilitating the user to clean the user's back, wherein said towel comprises a first panel having a first edge, a second panel having a second edge, and a third panel being coupled between said first edge of said first panel and said second edge of said second panel, said third panel being comprised of a resiliently stretchable material such that each of said first panel and said second panel are selectively urgeable away from each other thereby facilitating the user to stretch said towel along the user's back, said third panel being coupled to each of said first panel and said second panel such that said first edge and said second edge are flat and flush with said third panel when said third panel is unstretched.

2. The assembly according to claim 1, further comprising said first panel being comprised of a fluid absorbent material, said first panel being configured to be manipulated thereby facilitating said first panel to scrub the user when the user bathes.

3. The assembly according to claim 1, further comprising said second panel being comprised of a fluid absorbent material, said second panel being configured to be manipulated thereby facilitating said second panel to scrub the user when the user bathes.

4. The assembly according to claim 1, wherein said third panel is comprised of a textured material wherein said third panel is configured to frictionally engage the user's back thereby facilitating said third panel to scrub the user's back when the user bathes.

5. A towel assembly having a resiliently stretchable portion wherein said towel is configured to scrub a user's back, said assembly comprising:

a towel being configured to be manipulated during bathing thereby facilitating said towel to clean a user, said towel having a resiliently stretchable portion wherein said towel is configured to facilitate the user to stretch said towel along the user's back thereby facilitating the user to clean the user's back, said towel comprising:

a first panel having a first edge, said first panel being comprised of a fluid absorbent material, said first panel being configured to be manipulated thereby facilitating said first panel to scrub the user's body when the user bathes, a second panel having a second edge, said second panel being comprised of a fluid absorbent material, said second panel being configured to be manipulated thereby facilitating said second panel to scrub the user's body when the user bathes, and a third panel being coupled between said first edge of said first panel and said second edge of said second panel, said third panel being comprised of a resiliently stretchable material such that each of said first panel and said second panel are selectively urgeable away from each other thereby facilitating the user to stretch said towel along the user's back, said third panel being comprised of a textured material wherein said third panel is configured to frictionally engage the user's back thereby facilitating said third panel to scrub the user's back when the user bathes, said third panel being coupled to each of said first panel and said second panel such that said first edge and said second edge are flat and flush with said third panel when said third panel is unstretched.

* * * * *